US005950959A

United States Patent [19]

Milliorn

[11] Patent Number: 5,950,959

[45] Date of Patent: Sep. 14, 1999

[54] CONTAINER FOR STORING AND DISPENSING LABELS

[75] Inventor: James Michael Milliorn, Fort Worth, Tex.

[73] Assignee: DayDots Label Company, Inc., Ft. Worth, Tex.

[21] Appl. No.: 09/036,527

[22] Filed: Mar. 6, 1998

[51] Int. Cl.[6] ..... B65D 85/02

[52] U.S. Cl. ..... 242/588.3; 242/588.4; 206/409; 206/411

[58] Field of Search ..... 242/588.3, 588.4, 242/588.5, 594.5; 206/391, 394, 398, 403, 408, 409, 411, 467, 470, 459.5, 806

[56] References Cited

U.S. PATENT DOCUMENTS

| | | | |
|---|---|---|---|
| D. 276,590 | 12/1984 | Lobel | D9/341 |
| D. 283,789 | 5/1986 | Kodousek et al. | D9/341 |
| 1,487,607 | 3/1924 | Rosen | 242/588.3 X |
| 2,889,975 | 6/1959 | Hanlon | 242/588.3 X |
| 3,771,687 | 11/1973 | Krtous | 206/409 X |
| 3,948,455 | 4/1976 | Schwartz | 242/55.3 |
| 3,987,897 | 10/1976 | Smith | 206/226 |
| 4,201,354 | 5/1980 | Masiello et al. | 242/588.5 X |
| 4,252,258 | 2/1981 | Plummer, III | 225/25 |
| 4,512,474 | 4/1985 | Harding | 206/467 X |
| 4,586,671 | 5/1986 | Piana et al. | 242/594.5 |
| 4,637,514 | 1/1987 | Kildea et al. | 206/406 X |
| 4,700,835 | 10/1987 | Rognsvoog, Jr. | 206/411 |
| 4,735,342 | 4/1988 | Goldstein | 206/409 X |
| 4,735,531 | 4/1988 | Biswas | 225/25 |
| 5,053,795 | 10/1991 | Wyman | 206/409 X |
| 5,121,835 | 6/1992 | Grupe | 206/459.5 |
| 5,551,564 | 9/1996 | Prater et al. | 206/409 |
| 5,562,262 | 10/1996 | Pennell | 242/588.3 |
| 5,607,709 | 3/1997 | Fritz et al. | 206/459.5 X |
| 5,642,810 | 7/1997 | Warner et al. | 206/409 X |
| 5,775,516 | 7/1998 | McCumber et al. | 206/470 |

FOREIGN PATENT DOCUMENTS

| | | | |
|---|---|---|---|
| 60636 | 9/1982 | European Pat. Off. | 242/588.3 |
| 290389 | 4/1953 | Switzerland | 206/394 |
| 639915 | 12/1983 | Switzerland | 242/588.3 |
| 1573479 | 8/1980 | United Kingdom | 206/411 |

OTHER PUBLICATIONS

Catalog of Daydots Label Company, Inc. for Jan. 1996, 48 pgs.

*Primary Examiner*—Donald P. Walsh
*Assistant Examiner*—Minh-Chau Pham
*Attorney, Agent, or Firm*—Fulbright & Jaworski L.L.P.

[57] ABSTRACT

The present invention provides a clamshell container for storing and dispensing rolls of labels. The container has a top portion hinged along one edge to a bottom portion and a generally cylindrical shape with flanges extending along a longitudinal center plane. The bottom portion has transverse partitions providing semi-cylindrical compartments between the partitions, each compartment receiving a roll of labels. The flanges of the top and bottom portions on the ends and back have a channel, the channel comprising a U-shaped projection from the top portion which is received by a mating U-shaped recess in the bottom portion for a snap-fit, interlocking engagement of the top portion to the bottom portion. The top and bottom flanges on the front have a button for interlocking engagement of the top and bottom portions further ensuring that the container does not come open inadvertently. Aligned with each compartment, the front flange of the top portion has a contoured guideway for receiving and dispensing the roll of labels. As viewed from the outside the guideway has a concave curvature that allows a gentle bend of the labels as they are dispensed from the container. Aligned with the guideway in the front flange in the top portion, and the front flange of the bottom portion has a trough which guides the labels out of the container and prevents interleaving of one roll of labels with an adjacent roll of labels. The front flange of the top portion is set back from the front edge of the front flange of the bottom portion which provides finger space for sliding the labels out of the container.

20 Claims, 5 Drawing Sheets

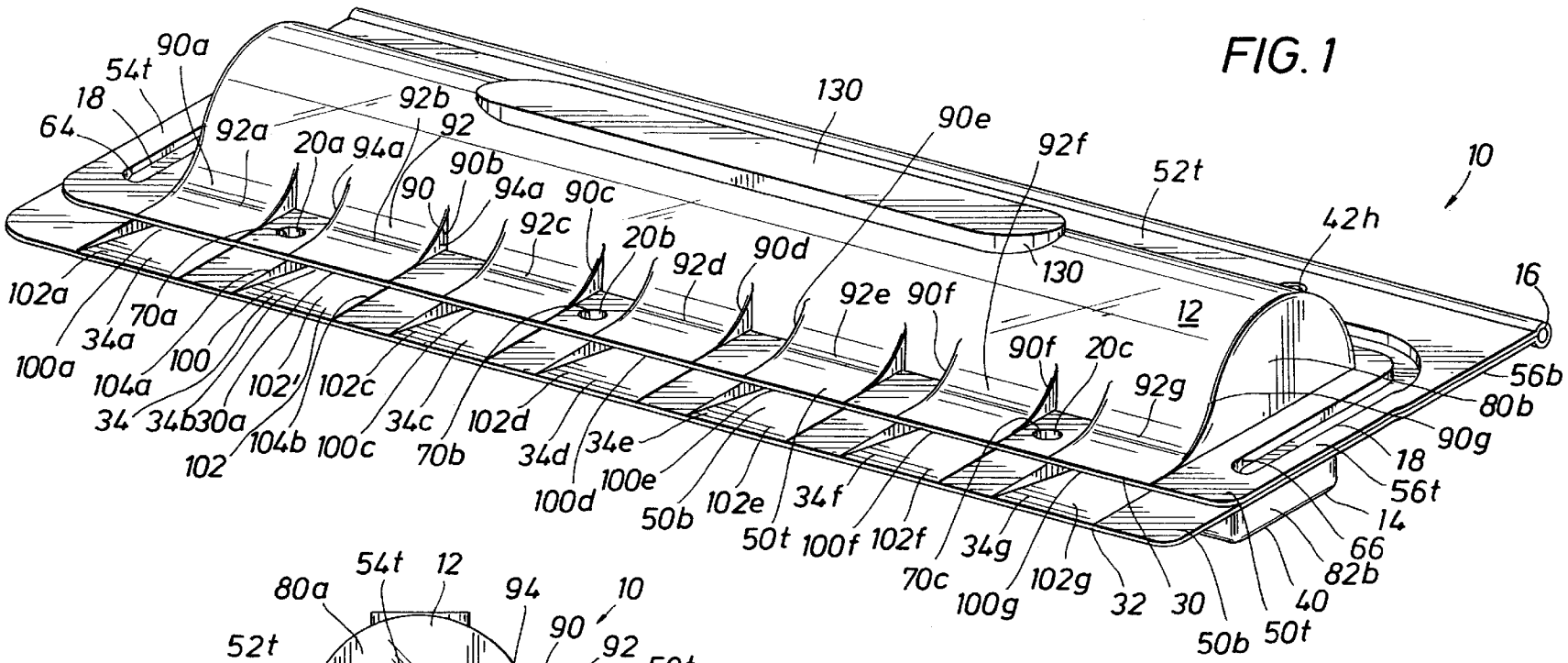
10
16
56b
80b
90g
18
56t
14
66
82b
40
50t
50b
30
32
102g
100g
70c
102f
100f
34f
50t
102e
50b
100e
100d
34d
34e
102d
70b
34c
100c
102c
104b
102
30a
34b
34
100
104a
70a
34a
100a
102a
64
18
54t
90a
92a
20a
94a
92b
90
92
90b
94a
92c
90c
20b
92d
90d
92e
90e
130
92f
52t
12
130
92g
20c
90f
90f
34

10
82a
54b
18
64
32
22a
24a
42a
22b
24b
22c
52b
24c
22d
18
24d
22e
24e
16
22f
24f
42b
14
22g
20a
W
20b
20c
34a
72a
34b
50b
34c
72b
34d
34e
34f
72c
34g
82b
18
56b
66

10
80a
54t
54b
14
18
82a
22a
40a
24a
22b
40b
24b
22c
40c
24c
22d
40d
24d
22e
40e
24e
22f
40f
24f
22g
40g
130
52t
52b
16
12
80b
56t
56b
18
82b 10
12
14
16
18
20
22
24
26
26a
30
30a
32
34
40
50b
50t
52b
52t
60
62
70
70b
72
72b
80a
82a
90
92
94a
92a
100
102'
104b
110
110a
112
112a
114
120
122
130
20b

CONTAINER FOR STORING AND DISPENSING LABELS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The invention relates to containers, and more particularly, to a container for storing and dispensing multiple rolls of labels.

2. Description of the Related Art

Labels of various kinds are sold in rolls. The labels have adhesive backings and during manufacture are placed on a lined paper. The lined paper with the adhesive-backed labels are wound on a cylindrical core, which may be made of paperboard or plastic. The rolls of labels have been packaged in a paperboard box with one roll per box.

A roll of labels dispenses easily from its box, and the adhesive-backed labels peel easily from the lined paper.

However, when a number of different labels need to be used and each roll of labels is in its own separate box, it is cumbersome to work with numerous boxes of labels. Further, because the boxes are not transparent, one cannot tell readily which labels are in which box or when a roll is nearing completion. Thus, one frequently does not know the inventory of a particular label is low until essentially the last label has been dispensed.

Containers for storing and dispensing multiple rolls of tape, as opposed to labels, have been disclosed. For example, in U.S. Pat. No. Des. 276,590 issued to Lobel, a dispenser is disclosed for holding multiple rolls of tape or the like. The container is a clamshell container having a generally cylindrical shape. The container is hinged along one longitudinal edge, and it has multiple compartments for receiving multiple rolls of tape. A serrated edge is provided for cutting the tape.

However, the container appears to be somewhat flimsy and thus subject to opening and spilling the rolls stored within. Two snap-fit buttons fasten a longitudinal top half to a longitudinal bottom half, where the buttons are located on opposing longitudinal ends. It is unacceptable for the dispenser to open inadvertently so as to allow the rolls of labels to spill out, particularly in a sanitary environment, such as in a food-preparation area. The rolls of labels would be contaminated from spilling onto a possibly contaminated surface, and it would be necessary to then discard the labels that had fallen out.

The container is also unsuitable for dispensing labels because the lined paper and adhesive-backed labels must transition from a circumferential position to a radial position through a sharp bend. A sharp bend creates significant friction between an outer, non-adhesive surface of the labels and an inner surface of the container at the bend, which can dislodge the adhesive-backed labels from the lined paper. Dislodged labels do not dispense properly and can jam a dispensing opening.

U.S. Pat. No. Des. 283, 789 issued to Kodousek et al. discloses a multiple reel tape dispenser. However, like the Lobel container, if rolls of labels were dispensed from the Kodousek et al. tape dispenser, the labels would have to transition from a circumferential position to a radial position through a sharp bend. Again, a sharp bend can cause the adhesive-backed labels to dislodge from the lined paper. Thus, the Kodousek et al. tape dispenser is not suitable for use with rolls of labels.

U.S. Pat. No. 3,948,455 issued to Schwartz discloses a dispenser package for shipping, displaying and dispensing convolutedly wound rolls of ribbon material. The Schwartz dispenser package has a number of features that would make it useful for dispensing labels. The package is transparent which would permit the visible inspection of the labels. The package, which is of the type referred to as a hinged clamshell, contains a plurality of hexagonally-shaped chambers, where each chamber can receive a roll of labels.

However, the labels would have to again transition from a circumferential position to a radial position through a relatively sharp bend, which is unsuitable for dispensing labels. Also, no opening is formed in the container for dispensing the ribbon between flanges of upper and lower shells of the package, which is suitable for its intended purpose of dispensing ribbon but unsuitable for dispensing a lined paper with attached adhesive-backed labels. There would be too much friction between the adhesive-backed labels and an inner surface of a flange, which would dislodge the adhesive-backed labels from the lined paper. Thus, like the containers discussed above, the Schwartz dispenser package is not suitable for storing and dispensing rolls of labels.

SUMMARY OF THE INVENTION

The present invention provides a clamshell container for storing and dispensing multiple rolls of labels, a roll of labels including a lined paper with adhesive-backed labels adhered to the lined paper. The container has a generally cylindrical shape with flanges extending from a longitudinal center plane. The container has front and back flanges, which have front and back edges, respectively. A top portion is hingedly connected to a bottom portion along the back edge of each portion. The bottom portion has a plurality of semi-cylindrical compartments separated by partitions, wherein each compartment is adapted for receiving a roll of labels.

In the front flange of the top portion a contoured wall extends outwardly from each compartment to provide a guideway for gradually bending the labels towards the front edge as the labels are dispensed. The contoured wall eliminates what would otherwise be a sharp bend as the labels transition from a circumferential position to a radial position. The contoured wall allows the labels to dispense essentially tangentially from its roll with a gradual curve to a radial discharge from the container. The dispensing of the labels is thus relatively frictionless.

The front flange of the bottom portion has a trough aligned with each compartment and extending from the compartment to the front edge. The front edge of the front flange of the bottom portion extends outwardly farther than the front edge of the front flange of the top portion. An opening for each compartment is defined by an inside surface of the top portion at its front edge and inside surfaces of walls defining the trough in the front flange of the bottom portion.

This arrangement allows a user to slide the lined paper and the adhesive-backed labels along the trough in the bottom flange towards the front edge of the bottom flange.

The lined paper can be bent downward at the front edge to separate the adhesive-backed label from the lined paper. The adhesive-backed label is thus easily removed from the lined paper.

BRIEF DESCRIPTION OF THE DRAWINGS

A better understanding of the present invention can be obtained when the following detailed description of the preferred embodiment is considered in conjunction with the following drawings, in which:

FIG. 1 is a perspective view of a container according to the present invention.

FIG. 2 is an end elevation of the container of FIG. 1.

DETAILED DESCRIPTION OF THE INVENTION

Figures 7, 8, 9:
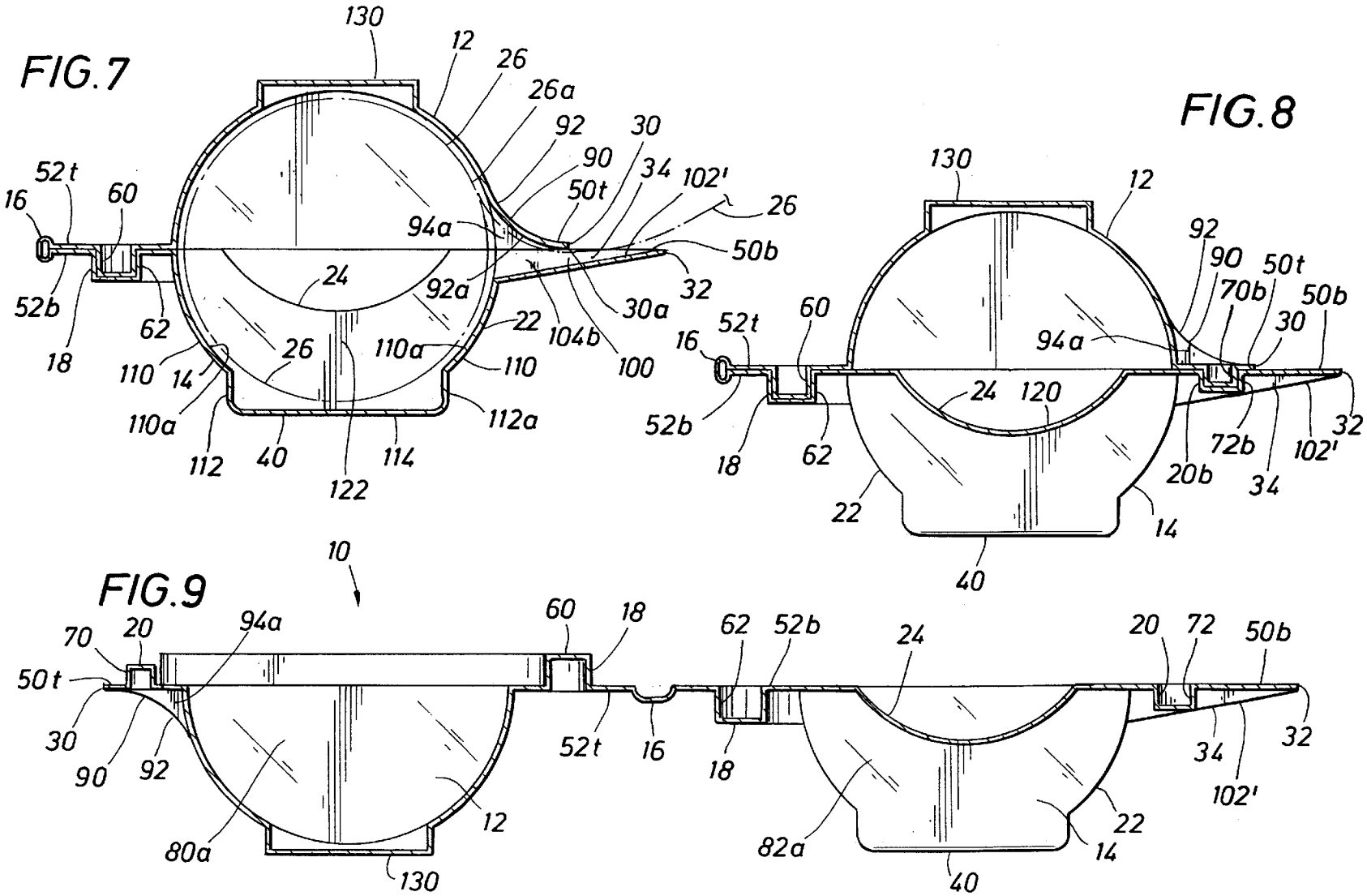
FIG. 7 is a cross-section of the container of FIG. 4 as seen along line 7—7 of FIG. 4.
FIG. 8 is a cross-section of the container of FIG. 4 as seen along line 8—8 of FIG. 4.
FIG. 9 is an end elevation of the container of FIG. 1 as seen in a fully open position.

With reference to FIGS. 1–4, a clamshell container 10 has a top portion 12 connected to a bottom portion 14 by a longitudinal hinge 16. Container 10 folds open along hinge 16 as illustrated in FIG. 9. Container 10 has a channel 18 that holds top portion 12 and bottom portion 14 in snap-fit, interlocking engagement. Buttons 20*a*, 20*b* and 20*c*, referred to generally as buttons 20, provide a snap-fit, interlocking engagement between top portion 12 and bottom portion 14. Buttons 20 cooperate with channel 18 to securely fasten top portion 12 to bottom portion 14 so that container 10 does not open unexpectedly. Alternatively, top portion 12 and bottom portion 14 can be separate components, with hinge 16 eliminated.

Figure 4:
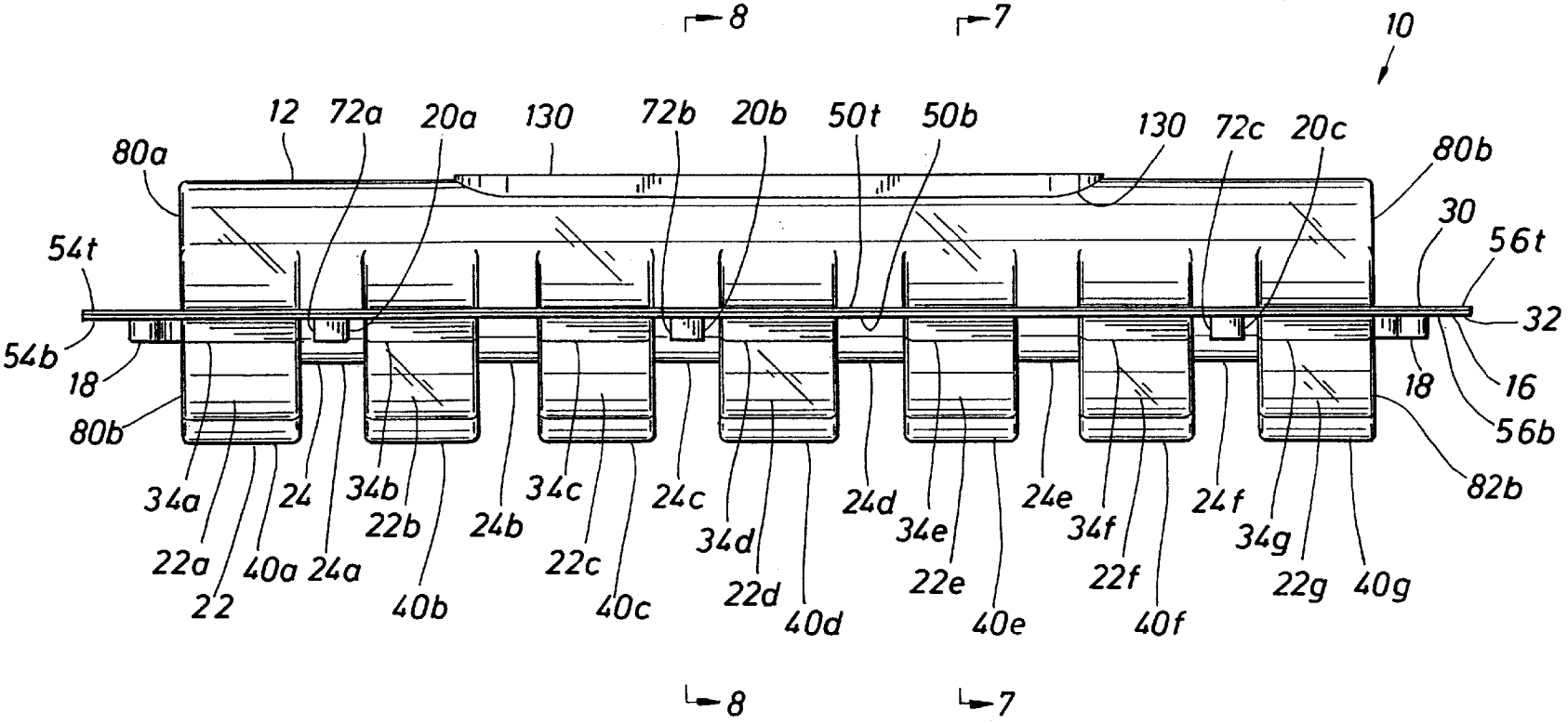
FIG. 4 is a front elevation of the container of FIG. 1.

Container 10 is shaped generally like a cylinder with top portion 12 providing an upper longitudinal half of the cylinder and bottom portion 14 providing a lower longitudinal half of the cylinder. As shown in FIG. 4, bottom portion 14 has a plurality of compartments 22*a*–22*g* separated by partitions 24*a*–24*f*, with partition 24*a* separating compartments 22*a* and 22*b* and so forth through partition 24*f* separating compartments 22*f* and 22*g*. The compartments and partitions are designated individually with letter subscripts, but are referred to generally as compartments 22 and partitions 24. Each compartment 22 has a generally semi-cylindrical cavity defined within bottom portion 14 for receiving a roll of labels 26 (shown in phantom lines in FIG. 7). Compartment 22 receives approximately the lower half of a roll, and the upper half of the roll is contained in top portion 12.

Container 10 is illustrated for use in a food storage or preparation area where the container has seven compartments 22 for receiving seven rolls of labels, one for each day of the week. The labels have an adhesive backing which is pressure-sensitive so that each label can be applied to a surface of an object by pressing the label onto the surface. The adhesive-backed labels are temporarily adhered onto a lined paper, which is a slick paper from which the adhesive-backed labels can be easily removed. The lined paper and the adhesive-backed labels are wound about a paperboard core to provide a roll of labels.

Container 10 can be thermally formed and molded from a sheet of semi-rigid, clear plastic, and it can also be formed by injection molding. In any case container 10 has walls that have a thickness of less than about one-sixteenth inch (less than about one mm). Various plastics can be used to form container 10 including polyvinyl chloride, polyethylene, polyethylene terephthalate, polypropylene and cellulose propinate. Container 10 is formed and shipped in the open position illustrated in FIG. 9.

Rolls of labels are placed in compartments 22 so that the lined paper and adhesive-backed labels unwind in a clockwise rotation as viewed in FIG. 2. The lined paper and adhesive-backed labels dispense from the top of roll 26, which is adjacent to top portion 12 (FIG. 7). The adhesive-backed labels are only temporarily adhered onto the upper, outside surface of the lined paper and are easily peeled off by a user. With a roll of labels placed in each compartment 22 and ends of the lined paper extending outside container 10, top portion 12 is folded at hinge 16 and fastened to bottom portion 14 using channel 18 and buttons 20 for snap-fit, interlocking engagement.

Top portion 12 and bottom portion 14 have front edges 30 and 32, respectively. Front edge 30 on top portion 12 is set back toward the interior of the container as compared to front edge 32 on bottom portion 14. The set back of front edge 30 from front edge 32 has advantages that are discussed below. To provide an opening suitable for dispensing the lined paper with the adhesive-backed labels, bottom portion 14 has guideways or troughs 34*a*–34*g* aligned with compartments 22*a*–22*g*, respectively. A user pulls the lined paper with the adhesive-backed labels out of container 10 and bends the lined paper down along edge 32, which tends to separate the adhesive-backed labels from the lined paper. The user then grasps the adhesive-backed label and peels it off the lined paper. The adhesive-backed label is applied on a desired surface, and the lined paper that carried the adhesive-backed label is torn off and discarded.

Container 10 can be used as a portable container for taking a plurality of labels to a work site. The wall of bottom portion 14 is extended at a lower portion of compartments 22*a*–22*g* to provide flat feet 40*a*–40*g*, respectively, so that container 10 rests evenly on a flat surface. Feet 40*a*–40*g* are referred to generally as feet 40 and provide a stable base so that container 10 can be set down and used without rocking on a cylindrical base. Container 10 can also be used as a somewhat permanent fixture, and for this purpose container 10 has holes 42*a* and 42*b* spaced longitudinal apart near hinge 16 for receiving pegs so that container 10 can be further stabilized.

Using holes 42*a* and 42*b* to receive pegs or hooks, container 10 can be hung on a vertical surface with the ends of the lined paper on the rolls of the labels pointed downward. With feet 40 resting against a flat, vertical surface, this is a particularly easy way to use container 10. Also, a device having vertical pegs for holes 42*a* and 42*b* can be used to receive container 10 for providing a horizontal fixture. The device can be permanently mounted to a flat, horizontal surface or can be heavier than container 10 and have a non-skid resting surface so that when labels are dispensed, container 10 is stationary.

Referring still to reference FIGS. 1–4 and considering additional structural components, top and bottom portions 12 and 14 of container 10 have front flanges 50*t* and 50*b*, respectively, where the suffixes t and b connote an association with top portion 12 and bottom portion 14, respectively. Likewise, container 10 has back flanges 52*t* and 52*b*, left end flanges 54*t* and 54*b* and right end flanges 56*t* and 56*b*. Channel 18 and buttons 20, which are used to close the container, are formed in these flanges.

Channel 18 extends continuously from left end flanges 54*t* and 54*b* through back flanges 52*t* and 52*b* to right end flanges 56*t* and 56*b*. With reference to FIGS. 7–9, channel 18 has a U-shaped cross-section. Top flanges 52*t*, 54*t* and 56*t* have a U-shaped projection 60, which is received in a mating U-shaped recess 62 formed in bottom flanges 52*b*, 54*b* and 56*b*. Projection 60 and recess 62 form channel 18. Projection 60 is slightly larger than recess 62, and when pressed together, the walls forming recess 62 stretch slightly to receive projection 60 in a snap-fit, interlocking engagement that fastens top portion 12 securely to bottom portion 14.

Figure 3:
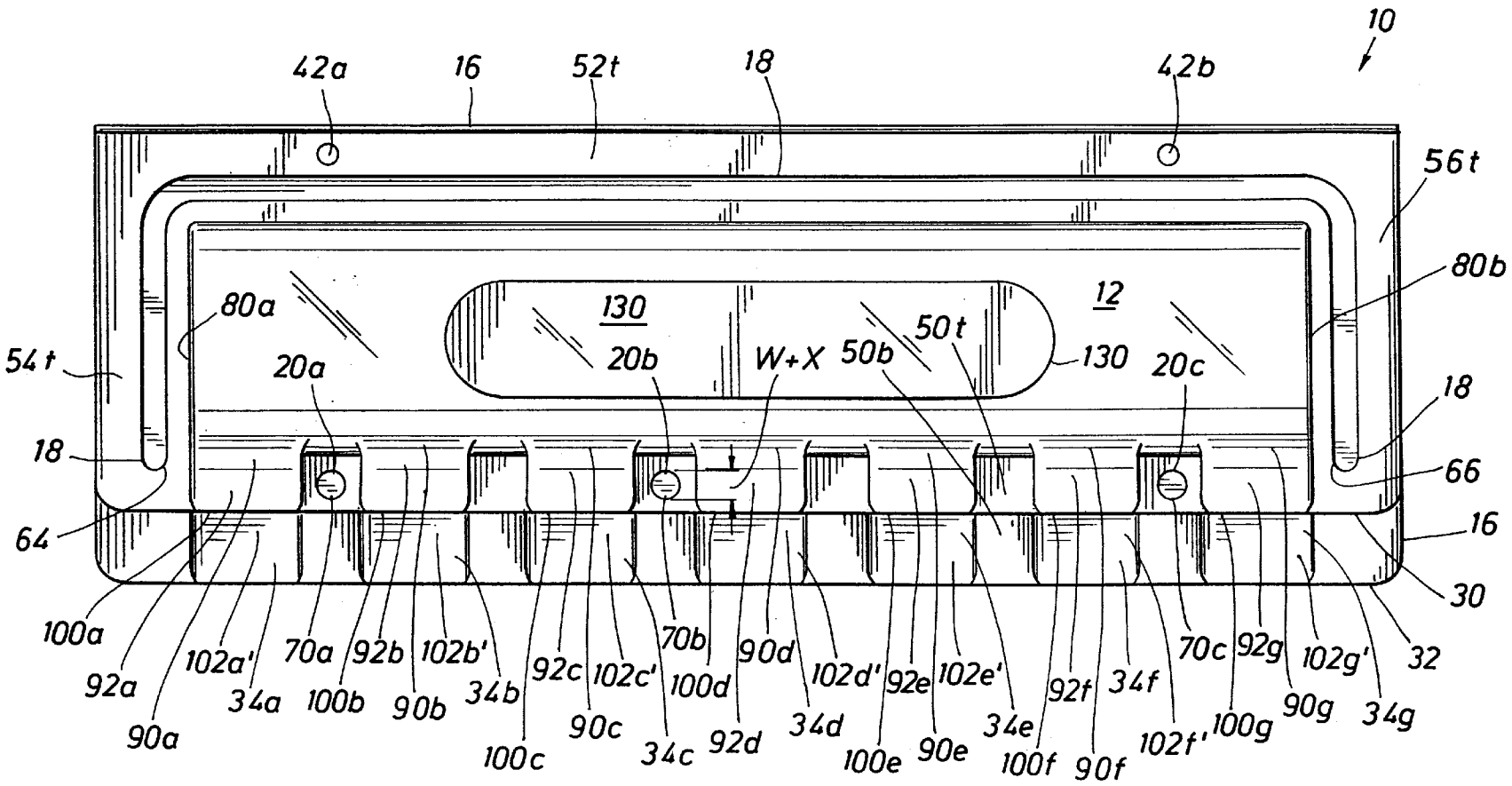
FIG. 3 is a top view of the container of FIG. 1.

Channel 18 continuously maintains the U-shaped profile provided by projection 60 and recess 62 from a first end 64 on left end flanges 54*t*, 54*b* through back flanges 52*t*, 52*b* to an end 66 on right end flanges 56*t*, 56*b*. Thus, channel 18 entirely fastens three of the four sides of container 10. Buttons 20*a*, 20*b* and 20*c* on front flanges 50*t* and 50*b* fasten the fourth side of container 10 to further ensure that container 10 does not come open inadvertently while in use. As best seen in FIGS. 3 and 9, for each button 20, front flange 50*t* on top portion 12 has a cylindrical projection 70 extending downward from its bottom surface. Front flange 50*b* on bottom portion 14 has a cube-shaped recess 72 for receiving projection 70 in a snap-fit, interlocking engagement, which further fastens top portion 12 to bottom portion 14.

Figure 5:
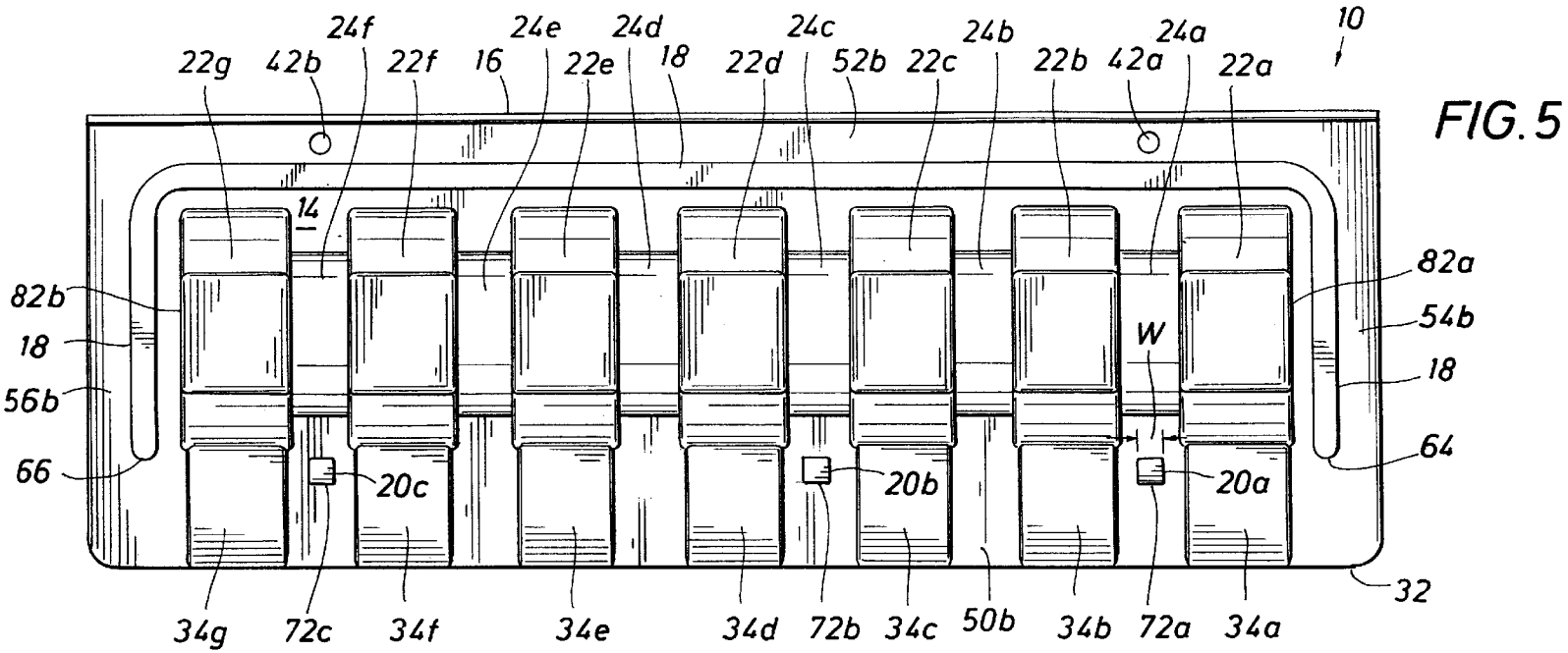
FIG. 5 is a bottom view of the container of FIG. 1.
Figure 6:
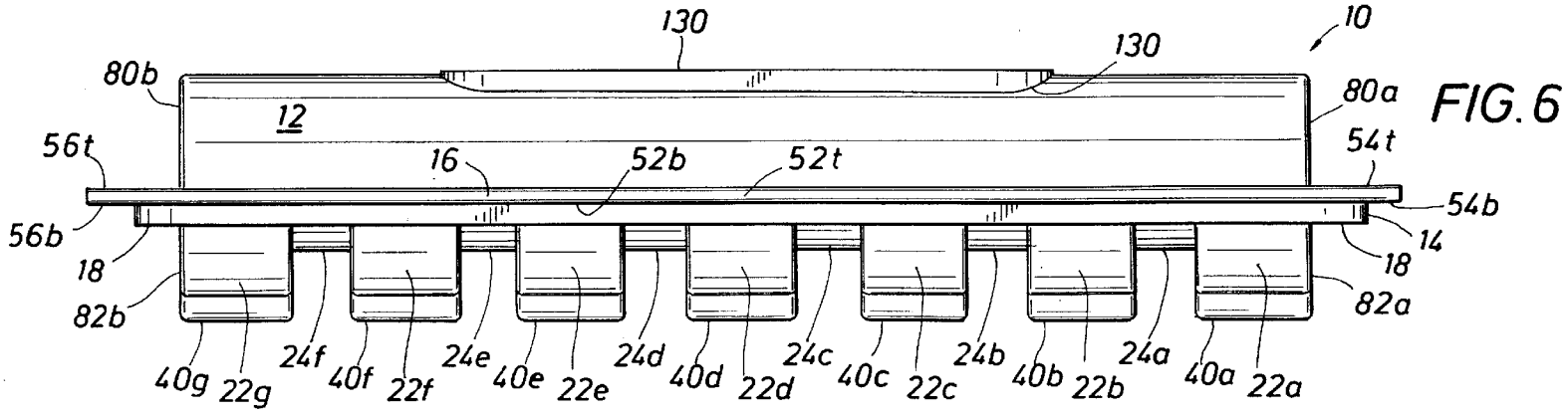
FIG. 6 is a back elevation of the container of FIG. 1.

As shown in FIG. 5, recess 72 has a square cross-section for receiving round projection 70. Recess 72 has a width w (FIG. 5), and projection 70 has a diameter of w+x (FIG. 3), so that projection 70 is slightly wider than recess 72. The side walls defining recess 72 stretch slightly to receive slightly larger projection 70, which provides a snapfit. Thus, buttons 20*a*, 20*b* and 20*c* each have a projection 70 and a recess 72 providing a snap-fit, interlocking engagement to fasten front flange 50*t* to front flange 50*b*, which further secures top portion 12 to bottom portion 14.

Container 10 includes further features for easily dispensing labels from the container. With reference to FIGS. 1 and 2, top portion 12 has a left end wall 80*a* and a right end wall 80*b*. Likewise, bottom portion 14 has a left end wall 82*a* and a right end wall 82*b*, as can be seen in FIG. 2. Together end walls 80*a* and 82*a* form a generally circular shape, each having a generally semi-circular shape. These shapes provide upper and lower portions 12 and 14 with generally semi-cylindrical shapes.

The adhesive-backed labels adhered to the lined paper are more easily dispensed if the labels are not dispensed through a sharp bend. For this reason, guideways 90*a*–90*g* are formed in front flange 50*t* of top portion 12 and aligned with compartments 22*a*–22*g*, respectively. Guideways 90*a*–90*g*, referred to generally as guideway 90, provide a contoured exit path for the labels. Thus, when the labels are dispensed, a sharp bend is avoided.

When the lined paper is pulled to unwind the roll of labels, the lined paper discharges tangentially from the roll. As best seen in FIGS. 1 and 7, guideway 90 has a contoured wall 92 that extends outward from container 10. Contoured wall 92 is contoured to accommodate the tangential discharge of the lined paper and the adhesive-backed labels. Contoured wall 92 is gently curved towards front edge 30 to provide a very gradual bend for easy dispensing of labels from container 10. Each guideway 90 has side walls 94*a* and 94*b* that define an interior guideway for receiving the lined paper and the adhesive-backed labels.

Side walls 94*a* and 94*b* have a generally triangular shape with contoured wall 92 providing a hypotenuse for the triangle, but whereas a true hypotenuse would be a straight line, contoured wall 92 is instead curved inwardly towards the interior of container 10. Contoured wall 92 and side walls 94*a* and 94*b* have interior surfaces 92*a* (FIG. 7), 94*a*' and 94*b*' (not shown), respectively. The labels contact these surfaces as the labels are dispensed, and thus, friction is a concern. Contoured wall 92 and its inside surface 92*a* are shaped so as to minimize friction between the labels and inside surface 92*a* as the labels are dispensed.

Again, guideway 90 is contoured so that the lined paper and the adhesive-backed labels discharge tangentially from a roll. With reference to FIGS. 2 and 7, ends 80*a* and 82*a* can be viewed as a clock face having twelve o'clock straight up and six o'clock straight down. The line formed where top portion 12 meets bottom portion 14 can be viewed as a three o'clock to the right and nine o'clock to the left. With this image in mind, then the lined paper and the adhesive-backed labels begin discharging from a roll at about a two o'clock position 26*a* (FIG. 7). Between the two o'clock position and the three o'clock position, the lined paper and the adhesive-backed labels transition from a circumferential or tangential orientation to a radial orientation so that the lined paper extends radially from the roll at the three o'clock position.

To provide relative dimensions, if ends 80*a* and 82*a* approximately form a circle having a radius r for receiving a roll of labels having a radius of r, then front flange 50*b* of bottom portion 14 extends outwardly a distance of approximately r. Front edge 30 of flange 50*t* of top portion 12 is set back towards the interior of the container as compared to front edge 32 of front flange 50*b* of bottom portion 14. Front flange 50*t* extends outwardly a distance of approximately r/2. In this context then side wall 94 of guideway 90 has sides at right angles that have a length of approximately r/2. Contoured wall 92 is again concave inwardly towards the interior of the container and has a radius of curvature of ranging between r/8 and 2r, preferably between r/4 and 1.5r, more preferably between r/2 and 1.2r and has a typical radius of curvature of about r. Thus, inside surface 92*a* typically has a radius of curvature of approximately r (FIG. 7).

As stated above and with reference to FIG. 1, front flange 50*b* of bottom portion 14 has troughs 34*a*–34*g* aligned with compartments 22*a*–22*g* and guideways 90*a*–90*g*, respectively. Referred to generally as trough 34, troughs 34*a*–34*g* provide a channel or guideway for dispensing labels from the containers. Top portion 12 has an inside surface 30*a* at front edge 30 (FIG. 7). Troughs 34*a*–34*g* and surface 30*a* define openings 100*a*–100*g*, respectively, through which the lined paper and adhesive-backed labels are dispensed. Troughs 34*a*–34*g* have a bottom walls 102*a*–102*g*, respectively, which have surfaces 102*a*'–102*g*' (FIG. 3). Bottom wall 102 and contoured wall 92 have essentially the same width, which is approximately equal to the width of the lined paper. Compartment 22 has an inside width slightly wider than the width of bottom wall 102 and contoured wall 92.

Trough 34 gradually deepens from front edge 32 to compartment 22 and has side walls 104*a* and 104*b*. Opening 100 is defined by walls 102, 104*a* and 104*b* and surface 30*a*. The recesses provided by guideways 90 and troughs 34 do not extend to front edges 30 or 32, respectively, and consequently, front edges 30 and 32 appear as straight lines in a front elevation (FIG. 4). Trough 34 begins at edge 32 and deepens as it approaches the interior of container 10, reaching a depth approximately equal to the depth of recess 62 of channel 18. Opening 100 provides a gap between surface 30*a* of top portion 12 and surface 102*a* of bottom portion 14 that is several times greater than the thickness of the lined paper and adhesive-backed labels, thus providing a relatively frictionless gap for dispensing labels from the container.

Alternatively, an opening can be provided by extending guideways 90 to front edge 30, in which case front edge 30 would have raised walls at guideways 90 for providing an opening. In this case troughs 34 can be eliminated. Also, slit openings in top portion 12 can be used to provide an opening for dispensing the labels. The slit openings would be in top portion 12 at about a two o'clock position, as discussed above, and aligned with each compartment. However, it would then be necessary to feed ends of the rolls through the slit openings when loading rolls of labels into the container, which would be cumbersome.

As the lined paper and adhesive-backed labels are dispensed, walls 104*a* and 104*b* in trough 34 and walls 94*a* and 94*b* in guideway 90 prevent interleaving of the labels between one guideway and an adjacent guideway. Further, front flange 50*t* of top portion fits tightly against front flange 50*b* of bottom portion 14, which further prevents the interleaving of the rolls of labels. Buttons 20 further prevent interleaving of the rolls of labels.

Turning now to FIG. 7, a cross-section of container 10 cut through compartment 22 shows a side elevation of partition 24. Compartment 22 in bottom portion 14 has a semicircular wall 110, which has an inner surface 110*a*. Wall 110 is molded so as to form extended walls 112 and 112*a* and a base wall 114. Foot 40, which provides a flat base for container 10 so that it can rest on a flat surface, is formed by extended walls 112 and 112*a* and base wall 114.

A roll of labels (phantom line 26) received in compartment 22 rests on inner surface 110*a* of wall 110. As the labels are dispensed, the roll rotates and friction is encountered between the labels and surface 110*a*. Extended walls 112 and 112*a* reduce the amount of surface area engaged with the roll of labels, which reduces the amount of friction between inside surface 110*a* and the roll of labels. Thus, foot 40 not only provides a stable base for container 10, but also reduces the amount of friction encountered between the roll of labels and inside surface 110*a* of wall 110 of compartment 22.

With reference to FIG. 8, a cross-section of container 10 cut through partition 24 shows a top wall 120 of partition 24, which is concave. Partition 24 has a side wall 122 (FIG. 7), and the roll of labels encounters some friction with side wall 122 as the roll of labels is rotated when the adhesive-backed labels are dispensed. By having a concave top wall 120 rather than a full wall, the amount of friction between a side of a roll of labels and side wall 122 is reduced.

The present invention thus provides a clamshell container adapted for storing and dispensing rolls of labels. The top portion has a raised surface 130 for receiving a company name or logo either by embossing or by receiving a label. Container 10, in this preferred embodiment, has seven storage compartments for receiving seven rolls of labels, one for each day of the week. In this application the labels are placed on food items to provide a record of the age of the food, where the food is to be discarded if not used by the day indicated by the label. The labels must be clean and hygienic, and container 10 provides a clean, hygienic environment for storing the labels. Top portion 12 locks tightly with bottom portion 14 due to the combination of channel 18 and buttons 20, and thus, it is very unlikely that the container will open unexpectedly and spill the rolls of labels.

Guideway 90, trough 34 and opening 100 provide a relatively frictionless exit path for dispensing the labels from the container. The set back of front edge 30 on front flange 50*t* leaves an open surface on front flange 50*b* of bottom portion of 14. This allows a user to press on a top surface of the lined paper or the adhesive-backed labels and to slide the lined paper outward along surface 102' of trough 34. As the adhesive-backed label approaches front edge 32 of front flange 50*b*, the lined paper can be bent downward so as to separate the adhesive-backed label from the lined paper for easy removal of the adhesive-backed label. In a typical embodiment the top front edge is set back from the bottom front edge by about ¾ of an inch, which allows easy access to the lined paper and the adhesive-backed labels.

Opening 100 has a sufficient gap so that the lined paper and adhesive-backed labels can be dispensed without friction. The contour of guideway 90 allows for particularly frictionless dispensing of the labels from the container. No sharp bends are encountered as the lined paper is discharged tangentially from the roll and allowed to transition gently to a radial position for dispensing the labels. This contour minimizes the possibility of dislodging the adhesive-backed labels from the lined paper, which can jam the opening and cause more adhesive-backed labels to become dislodged from the lined paper. The contour in guideway 90 minimizes friction while dispensing the labels, but yet creates enough friction against the labels to keep the roll from unwinding too rapidly.

The foregoing disclosure and description of the invention are illustrative and explanatory thereof, and various changes in the details of the illustrated apparatus and construction and method of operation may be made without departing from the spirit of the invention.

I claim:

1. A storing and dispensing container for a plurality of rolls of labels, a roll of labels including a roll of lined paper and adhesive-backed labels adhered to the lined paper, the container comprising:

a clamshell container having a top portion and a bottom portion, the bottom portion having a plurality of semi-cylindrical compartments, each compartment being adapted for receiving a roll of labels;

the top portion having a front top flange and the bottom portion having a front bottom flange;

the front top flange being adapted to provide a contoured guideway aligned with each compartment for guiding the lined paper and the adhesive-backed labels dispensed from each compartment;

the guideway having a contoured outer wall;

the contoured outer wall being concave as viewed from outside the container; and the front top and bottom flanges being sized and shaped to provide a frictionless opening through which the lined paper and adhesive-backed labels are dispensed.

2. The container of claim 1, wherein the contoured outer wall has a radius of curvature of at least one-eighth the radius of a roll of labels supported within or of the compartments.

3. The container of claim 1, wherein the front flanges of the top and bottom portions each have front edges, the front edge of the bottom portion extending farther outward than the front edge of the top portion.

4. The container of claim 3, wherein the front flange of the bottom portion has a trough aligned with each guideway for guiding the lined paper and the adhesive-backed labels as the lined paper and the adhesive-backed labels are dispensed.

5. The container of claim 4, wherein an opening is defined between the front edge of the top portion and the trough for dispensing the lined paper and the adhesive-backed labels from the compartment.

6. The container of claim 3, wherein the guideway in the front flange of the top portion does not extend to the front edge of the top portion.

7. The container of claim 1, wherein the top and bottom portions each have a left, a back and a right flange and a channel formed in the left, back and right flanges of the top and bottom portions for fastening the top portion to the bottom portion in a snapfit, interlocking engagement, the channel having a U-shaped cross-section.

8. The container of claim 7, wherein the top portion is connected to the bottom portion by a hinge.

9. The container of claim 7, wherein the back flanges of the top and bottom portions have a mating hole for receiving a peg.

10. The container of claim 1, wherein the top portion has a generally semi-cylindrical shape.

11. The container of claim 1, wherein the top portion has a raised surface for receiving a company name or logo.

12. The container of claim 1, wherein each compartment has downwardly extending walls and a base wall for providing a foot so that the container rests evenly on a flat surface.

13. A storing and dispensing container for a plurality of rolls of labels, a roll of labels including a roll of lined paper and adhesive-backed labels adhered to the lined paper, the container comprising:

a clamshell container having a top portion and a bottom portion, the bottom portion having a plurality of semi-cylindrical compartments, each compartment being adapted for receiving a roll of labels;

the top and bottom portion each having a front flange, the front bottom flange having a front edge;

the front bottom flange being formed to provide a trough aligned with each compartment, the trough extending form the compartment to the front edge; and the front top and bottom flanges being sized and shaped to provide a frictionless opening through which the lined paper and adhesive-backed labels are dispensed.

14. The container of claim 13, wherein the front flange of the top portion has a contoured guideway aligned with each compartment and each through, the guideway having a contour for receiving the labels in a relatively tangential position, the contour transitioning the labels to an essentially radial position though a relatively gentle bend, the contour being concave as viewed from outside the container.

15. The container of claim 14, wherein the contoured guideway and the semi-cylindrical compartment each have a radius of curvature, the radius of curvature of the semi-cylindrical compartment is r, and the radius of curvature of the contoured guideway is greater than r/8.

16. A container, comprising:

a sheet of plastic molded to form a top half hinged along a back edge to a back edge of a bottom half, the top half folding at the hinge onto the bottom half to form a generally cylindrical shape with front, back and end flanges formed on the top and bottom halves, the flanges extending outward from a center longitudinal plane of the generally cylindrical shape;

the front flanges of the top and bottom halves being sized and shaped to provide a opening through which a roll of lined paper and adhesive-backed labels can be frictionally dispensed;

the bottom half having a plurality of transverse partitions for defining compartments;

an interlocking channel having a generally U-shaped cross-section being formed in each end flange and the back flange of the top and bottom halves for fastening the top half to the bottom half; and an interlocking button being formed on the front flanges for fastening the top half to the bottom half, the button comprising a recess formed in the front flange of the bottom half, the recess having a square cross-section of width w, and a projection formed in the front flange of the top half, the projection having a circular cross-section of diameter w+x, the projection being matingly received by the recess in interlocking engagement for fastening the top half to the bottom half.

17. The container of claim 16, wherein the front flange of the bottom half has a trough between adjacent partitions aligned essentially parallel with the partitions.

18. The container of claim 17, wherein the front flange of the bottom half has a front edge and the trough has a depth, the depth being essentially zero at the front edge and gradually deepening toward a compartment.

19. The container of claim 16, wherein the front flange of the top half has a contoured guideway aligned with each compartment, the guideway extending outwardly and having a concave shape as viewed from outside the container.

20. The container of claim 16, wherein the front flange of the bottom half has a trough aligned with each compartment and being essentially parallel with the partitions, and the front flange of the top half has a contoured guideway aligned with each trough, the guideway extending outwardly and having a concave shape as viewed from outside the container.

* * * * *